US005353872A

United States Patent [19]

Wittrisch

[11] Patent Number: 5,353,872

[45] Date of Patent: Oct. 11, 1994

[54] SYSTEM, SUPPORT FOR CARRYING OUT MEASURINGS AND/OR SERVICINGS IN A WELLBORE OR IN A WELL IN THE PROCESS OF BEING DRILLED AND USES THEREOF

[75] Inventor: Christian Wittrisch, Rueil-Malmaison, France

[73] Assignee: Institut Francais du Petrole, Malmaison Cedex, France

[21] Appl. No.: 923,560

[22] Filed: Aug. 3, 1992

[30] Foreign Application Priority Data

Aug. 2, 1991 [FR] France ..... 91 09916

[51] Int. Cl.[5] ..... E21B 47/12

[52] U.S. Cl. ..... 166/250; 166/382; 166/385; 175/50; 73/151

[58] Field of Search ..... 166/250, 254, 255, 380, 166/385; 175/45, 50; 73/151

[56] References Cited

U.S. PATENT DOCUMENTS

| | | | |
|---|---|---|---|
| 3,664,416 | 5/1972 | Nicholas | 166/65 |
| 4,126,848 | 11/1978 | Denison | 340/18 LD |
| 4,325,438 | 4/1982 | Zuvela | 175/50 |
| 4,349,072 | 9/1982 | Escaron et al. | 166/250 |
| 4,664,189 | 5/1987 | Wittrisch | 166/250 |
| 4,690,214 | 9/1987 | Wittrisch | 166/65.1 X |
| 5,107,939 | 4/1992 | Lenhart | 175/61 |
| 5,180,011 | 1/1993 | Wittrisch | 166/250 |
| 5,207,096 | 5/1993 | Castel et al. | 166/250 X |
| 5,217,072 | 6/1993 | Wittrisch | 166/250 |

FOREIGN PATENT DOCUMENTS

| | | |
|---|---|---|
| 0404669 | 12/1990 | European Pat. Off. . |
| 2501777 | 9/1982 | France . |
| 1557863 | 12/1979 | United Kingdom . |

*Primary Examiner*—Terry Lee Melius

*Attorney, Agent, or Firm*—Antonelli, Terry, Stout & Kraus

[57] ABSTRACT

A system for carrying out measurements and/or services in a wellbore or a well in the process of being drilled includes an electrical link connecting a surface control unit to a sonde comprising measuring and/or servicing devices fastened to a lower end of a cable section; an assembly including a sub for anchoring the sonde; a cable section having at an upper end thereof a first intermediate electrical connector integral with a support; the electrical link being provided by a cable linked to the surface control unit and having at a lower end thereof a second intermediate electrical connector adapted to be connected to the first intermediate electrical connector. The support is adapted to be made integral with an inner wall or a drill string.

18 Claims, 7 Drawing Sheets

H

SYSTEM, SUPPORT FOR CARRYING OUT MEASURINGS AND/OR SERVICINGS IN A WELLBORE OR IN A WELL IN THE PROCESS OF BEING DRILLED AND USES THEREOF

FIELD OF THE INVENTION

The present invention relates to a system and a device for carrying out measurings and/or servicings in a wellbore or in a well in the process of being drilled by means of an electric link linking the surface to a sonde comprising measuring and/or servicing means.

The electric link comprises a cable section co-operating through the lower end thereof with measuring and/or servicing means and comprising at the upper end thereof a first intermediate connector integral with a support, a second intermediate connector adapted for co-operating electrically with the first intermediate connector and fastened to a cable connected with the surface.

BACKGROUND OF THE INVENTION

Patent FR-2,501,777 mentions a known method and device for carrying out measurings and/or servicings from a sonde fastened to the end of a drill string, but this document only relates to logging devices and has no intermediate connectors. The rotating of the whole of the string in the well is impossible when the sonde is connected because of the presence within the drill string of the coaxial cable, or annular when a side-entry sub is used.

The present invention allows to link measuring and/or servicing means and allows notably the rotating of the whole of the string and the adding of pipes without requiring the means with the total coaxial cable to be taken up to the surface, by means of intermediate connectors and of an adapted support.

Document GB-1,557,863 mentions a known method and device for transmitting information coming from a sonde lowered in a drill string, said sonde being suspended to a cable section, said section being linked to the surface by means of a connector and of a cable. The sonde is lowered into the string at the end of the cable and must therefore have an outside diameter compatible with the inner passage of the tubular string. The setting of the device for suspending the section is achieved at the surface.

The present invention advantageously allows a sonde comprising measuring and/or servicing means to be lowered in a drill string, said sonde being fastened to the end of a cable section which comprises a support for a first intermediate connector. Linking is achieved by a second intermediate connector fastened to the end of a cable linked to the surface. In order to operate the pipes so as to take them down or up, the support is made integral with the drill string by remote control from the surface. The cable length then just has to be taken up above the second intermediate connector, which only requires a very short time and allows high capacity transmissions by means of the cable. No cable in the annulus, as it is commonly the case in this field when a side-entry sub is utilized, is also advantageous when safety imposes an annular seal at the well-head, either continuously in case of air drilling or foam drilling, or occasionally when the bottomhole pressure is unbalanced. In these cases, the cable is bothersome and sometimes dangerous.

In certain strongly deflected wellbores, notably those with a small bending radius, this invention is economically very interesting for the phase of control of the trajectory of the wellbore in the curve and in the substantially horizontal part. In fact, the tools used in the prior art use notably a transmission by pressure waves in the fluid so as to be able to rotate the whole string without the cable being in the way or having to be taken up completely. With the invention, the length of the section may correspond to the kick-off point, and since the length of the wellbore with a small bending radius is limited to several hundred meters, maneuvering the cable connected to the surface is simple and fast during the total deflection phase. With the invention, the frequency of the measurings and servicings is thus comparable to what can be obtained with transmissions without an electric cable, and moreover with a lesser cost and complexity. Besides, rotating the whole string is allowed when the cable has been taken up to the surface.

In the case of very deep and therefore very high temperature drilling, the invention will be advantageously applied because it provides a mechanical support for taking up the weight of the cable and the tensile strains generated on the cable notably through an energetic circulation of a cooling fluid. In fact, in deep drillings, the tension which a continuous cable would withstand is higher than the allowable tension. The solution therefore consists in having intermediate supports of sections with an acceptable length.

SUMMARY OF THE INVENTION

The present invention relates to a system for carrying out measurings and/or servicings in a wellbore or a well in the process of being drilled and comprising at the end of a drill string an assembly comprising a sub adapted for receiving a sonde comprising measuring and/or servicing means, said drill string going up to the surface, said sonde being fastened mechanically to the lower end of a cable section of non zero length comprising electric conductors and whose other end is fastened to a support adapted for being made integral with said drill string and comprising a first intermediate electric connector, a second intermediate electric connector adapted for co-operating with said first intermediate connector, this second intermediate electric connector being fastened mechanically to the lower part of a cable comprising electric conductors and connected electrically to the surface.

According to the invention, said support of the first intermediate connector is made integral by remote control from the surface.

Said second intermediate connector may be adapted for being taken up to the surface, said support remaining integral with the drill string.

Said sonde may be anchored in said sub.

Said support may be made integral on any zone of the inner channel of the drill string and it may be adapted for holding said section substantially taut.

Said section and said sonde may be taken up to the surface, through said drill string, either by using said cable, or by means of a fishing tool adapted for connecting onto the upper end of said support.

The cable associated with the second intermediate connector may pass through a special sub fitted with a side-entry.

Said first intermediate connector may co-operate with the lower end of a first cabled pipe, other cabled pipes may be assembled above this first pipe so as to displace the drill string and said assembly, and said first intermediate connector may be linked electrically to the surface through said cabled pipes.

Said sub may comprise a system for the angular orientation of said sonde.

Said assembly may comprise directional drilling means and the position of said drilling means may be controlled from the surface through said measuring means.

In another variant, said assembly may comprise other measuring and/or servicing means linked electrically to a first connector integral with said assembly and said sonde may comprise a second connector adapted for connecting to the first one.

At least one of the second intermediate connector or of the sonde may comprise weights such as load bars and/or a device adapted for pumping in the channel of the drill string.

The invention also provides a support for a first intermediate connector placed in the inner channel of a conduit by means of a second intermediate connector connected to the first one and fastened to a cable linked to the surface.

The support may exhibit two states. In a first state, said support is anchored in said channel, and in the other state, said support may be displaced freely in said channel. Passing from one state to the other is achieved by remote control from said cable linked to the surface and the support is adapted for anchoring in any zone of the inner channel of the conduit.

The support according to the invention may comprise a shaft integral, on one side, with said first electric connector and, on the other side, with a cable section comprising electric conductors, a body coaxial to said shaft and which may be displaced in translation between two extreme positions with respect to said shaft, said positions corresponding to the two states. A locking means may make said body integral with said shaft in the position corresponding to the displacement state.

In the invention, the displacement state of said support may be removed by unlocking the locking system through electric remote control, said system may be reversible, and the anchoring state of said support may be removed by applying a traction on said shaft notably through said cable connected to the surface.

The body of said support may comprise friction pads adapted for holding substantially fixed said body in relation to said channel when said shaft is displaced in translation between two positions.

The support may comprise anchoring wedges, inoperative when said body is in the position of displacement of said support. Said wedges may be adapted for anchoring the support in the channel through the co-operation of expansion means when said body is in the anchoring position and, when the expansion means are integral with the shaft, the wedges may be integral with the body or conversely.

The connection between the two intermediate connectors may be adapted for being disconnected while leaving the support in the anchored state thereof.

The system and the support according to the invention will be advantageously used for recording measurements and/or for carrying out selective servicings in an oil well, while having the possibility to add pipes and/or rotate the whole drill string and said assembly between each measurement and/or servicing.

BRIEF DESCRIPTION OF THE DRAWINGS

Other features and advantages of the present invention will be clear from reading the description hereafter of non limitative examples, with reference to the accompanying drawings in which.

DESCRIPTION OF THE PREFERRED EMBODIMENTS

Figure 5:
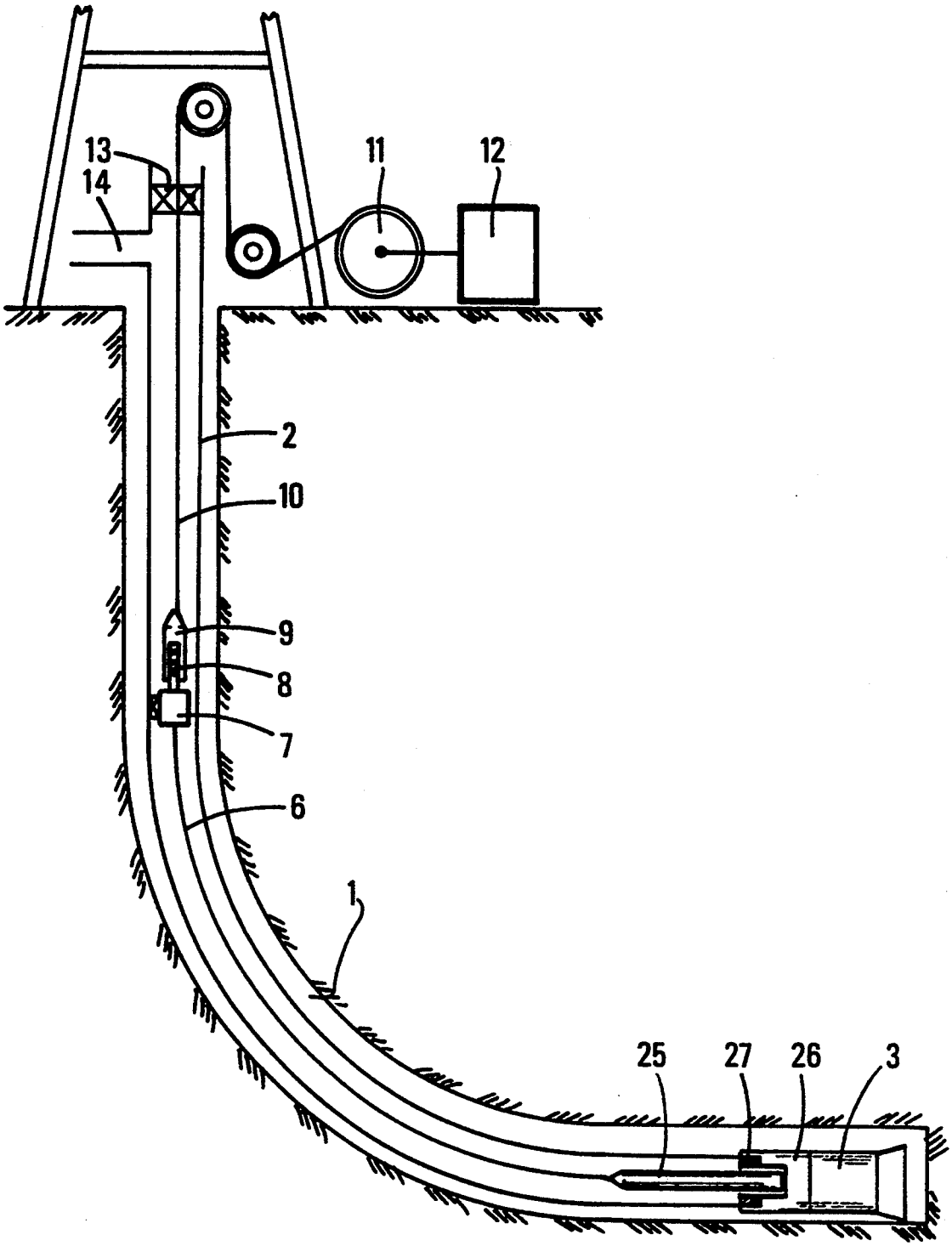
FIG. 5 shows the configuration according to the invention.

The present invention relates to the configuration of FIG. 5.

FIG. 5 shows a wellbore 1 containing a drill string 2 at the end of which an assembly 3 comprising a sub 26 is assembled. Sub 26 comprise a means for guiding and centering the sonde so that it works properly. This sub may also comprise a conventional mechanical anchoring means, for example that which is described in patent FR-2,501,777 cited above, and possibly an angular orientation system for said sonde of the mule-shoe type.

In the preferred embodiment, assembly 3 comprises no measuring and/or servicing means.

A sonde 25 comprising measuring and/or servicing means is mechanically fastened to the lower end of a cable section 6 comprising electric conductors. The upper end of this section comprises a first intermediate connector 8 integral with a support 7 which makes this first intermediate connector integral in the inner channel of the drill string.

A second intermediate connector 9 fastened to the end of a cable 10 is connected onto the first intermediate connector. Cable 10 comprises electric conductors, comes out through the upper end of the drill string and passes on pulleys before being wound round a winch 11. The electric conductors of this cable are connected to an electric joint rotating around the axis of the winch drum so as to be linked to a control cab 12.

A circulating head fitted with the conduit 14 allows to pump the drilling fluid in the inner channel of the drill string, to feed the downhole motor so as to actuate the drill bit and to clear the annulus of the cuttings. The circulating head comprises an annular seal 13 adapted to cable 10. This head is well-known in the prior art. In the configuration of FIG. 5, the sonde comprising measuring and servicing means is electrically linked to the surface by cable section 6, the two intermediate connectors and cable 10. It is thus possible to work practically over the length of the pipes located above the drill floor.

FIGS. 1, 1A, 2, 2A, 3, 4A and 4B relate to the setting or to the withdrawal of section 6, of support 7, of the connection of sonde 25 and sub 26, of intermediate connectors 8 and 9, of the cabled pipes. The co-operation of the end of the sonde and of sub 26 may be a simple guiding, a mechanical anchoring, an angular guiding or even an electrical co-operation if the two elements 25 and 26 co-operating with one another comprise a pair of connectors 4 and 5.

The description hereafter relates to the latter case, but this description also perfectly applies if there is no pair of electric connectors 4 and 5. Under these conditions, sonde 25 has a function equivalent to that of second connector 5 and sub 26 has the function of the first connector 4, except for the electric co-operation function of connectors 4 and 5.

Figure 1:
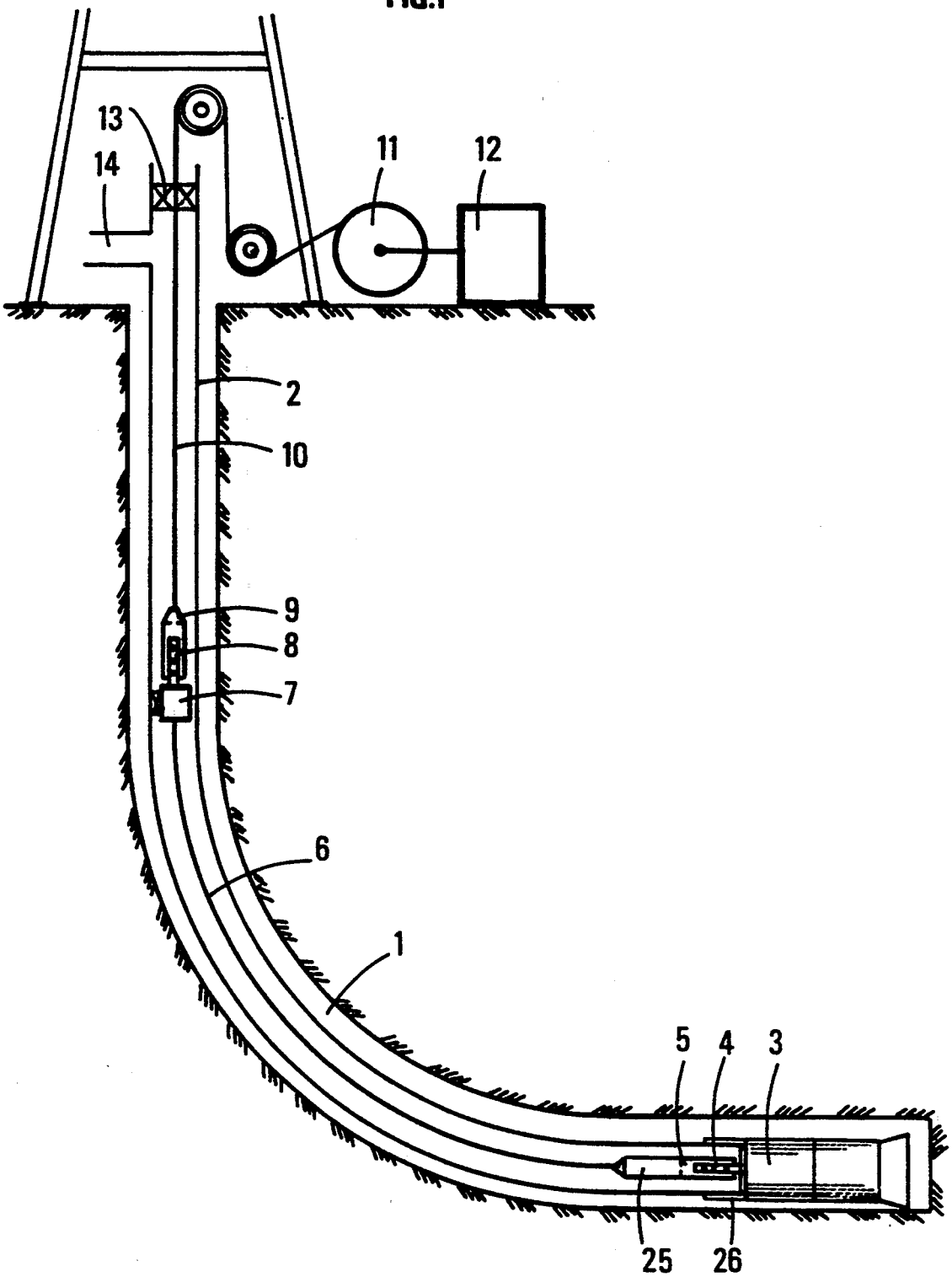
FIG. 1 shows a drilling assembly fastened to the end of a drill string and linked to the surface through an electric link.
Figure 1A:
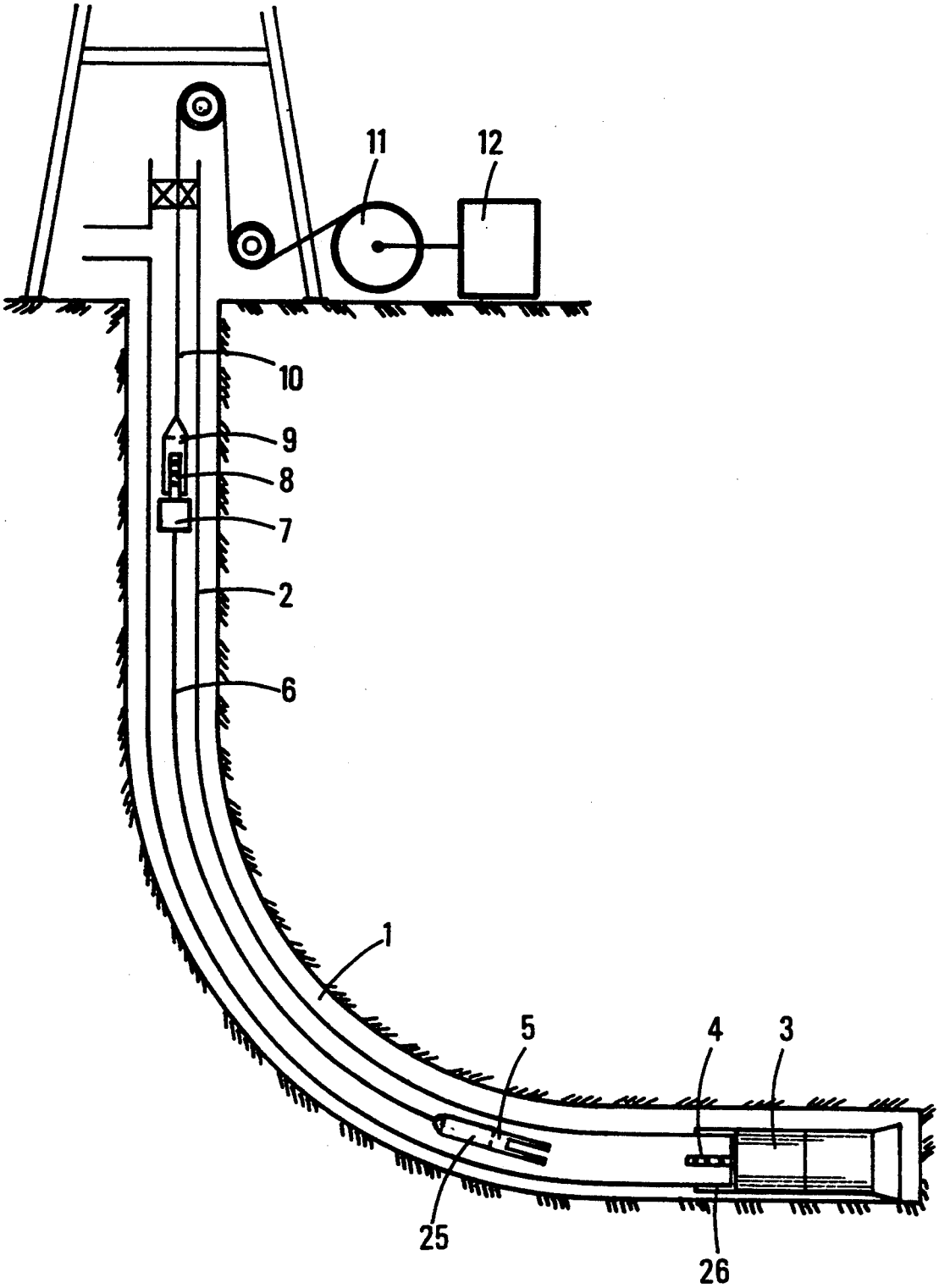
FIG. 1A shows the assembly before the connection.

FIG. 1 shows a wellbore 1 containing a drill string 2 at the end of which an assembly 3 comprising a first connector 4 integral with said assembly 3 is assembled. The assembly comprises measuring and servicing means electrically linked to the first connector 4.

A second connector 5 connected onto connector 4 is fastened mechanically to the lower end of a cable section 6 comprising electric conductors. The upper end of this section comprises a first intermediate connector 8 integral with a support 7 which makes this first intermediate connector integral in the inner channel of the drill string. The connection of connectors 4 and 5 is locked by a mechanical system which will be described hereafter.

A second intermediate connector 9 fastened to the end of a cable 10 is connected to the first intermediate connector. Cable 10 comprises electric conductors, comes out through the upper end of the drill string and passes on pulleys being wound round a winch 11. The electric conductors of this cable are connected to an electric joint rotating around the axis of the winch drum so as to be linked to a control cab 12.

A circulating head fitted with the conduit 14 allows to pump the drilling fluid in the inner channel of the drill string, to feed the downhole motor so as to actuate the drill bit and to clear the annulus of the cuttings. The circulating head is adapted for providing an annular seal 13 around cable 10. This head is well-known in the prior art. In the configuration of FIG. 1, the measuring and servicing means are linked electrically to the surface through the two pairs of connectors, cable section 6 and cable 10. It is thus possible to work practically over the length of the pipes located above the drill floor.

Without departing from the scope of this invention, the upper end of the drill string may be a kelly topped by the conventional swivel but equipped with a sealing means 13 at the outlet of and around cable 10, also if a power swivel replacing both the kelly and the swivel is used, said power swivel comprising of course the sealing means 13 around the cable.

In this embodiment, the assembly 3 comprising a connector 4 may notably be made up of:

- logging tools,
- formation testing tools, such as a DST device comprising a packer, a valve on the drill string channel and pressure sensors,
- sampling tools such as a RFT marketed by Schlumberger,
- tools for carrying out measurings and servicings on the equipments of wells in production,
- perforating tools,
- tools with or without a downhole motor for redrilling packers, valves, etc,
- drilling means with or without a downhole motor and comprising measuring and/or servicing means, notably sensors for locating said assembly.

All these assemblies are linked to the surface through the electric link and afford the advantage of having the possibility of direct transmission or control.

In the case of a drilling assembly comprising a drill bit, possibly a downhole motor, location sensors, it may be advantageous to have deflecting tools as a bent sub and variable geometry stabilizer which may be controlled by means of the electric link.

The support 7 of the first intermediate connector 8 is made integral with the drill string, in accordance with the following two functional principles:

1) it is either arranged substantially close to the surface (FIG. 2), which means that, in this case, the length of the drill string corresponds substantially to the length of cable section 6,
2) or the drill string is assembled down to the point where the electric link is required for connecting said assembly. The cable section 6 connected to cable 10 (FIG. 1A) through the connection of intermediate connectors 8 and 9 is then lowered into the inner channel of the pipes, so as to connect connectors 4 and 5 and to make support 7 integral with the inner channel of the drill string.

Figure 2:
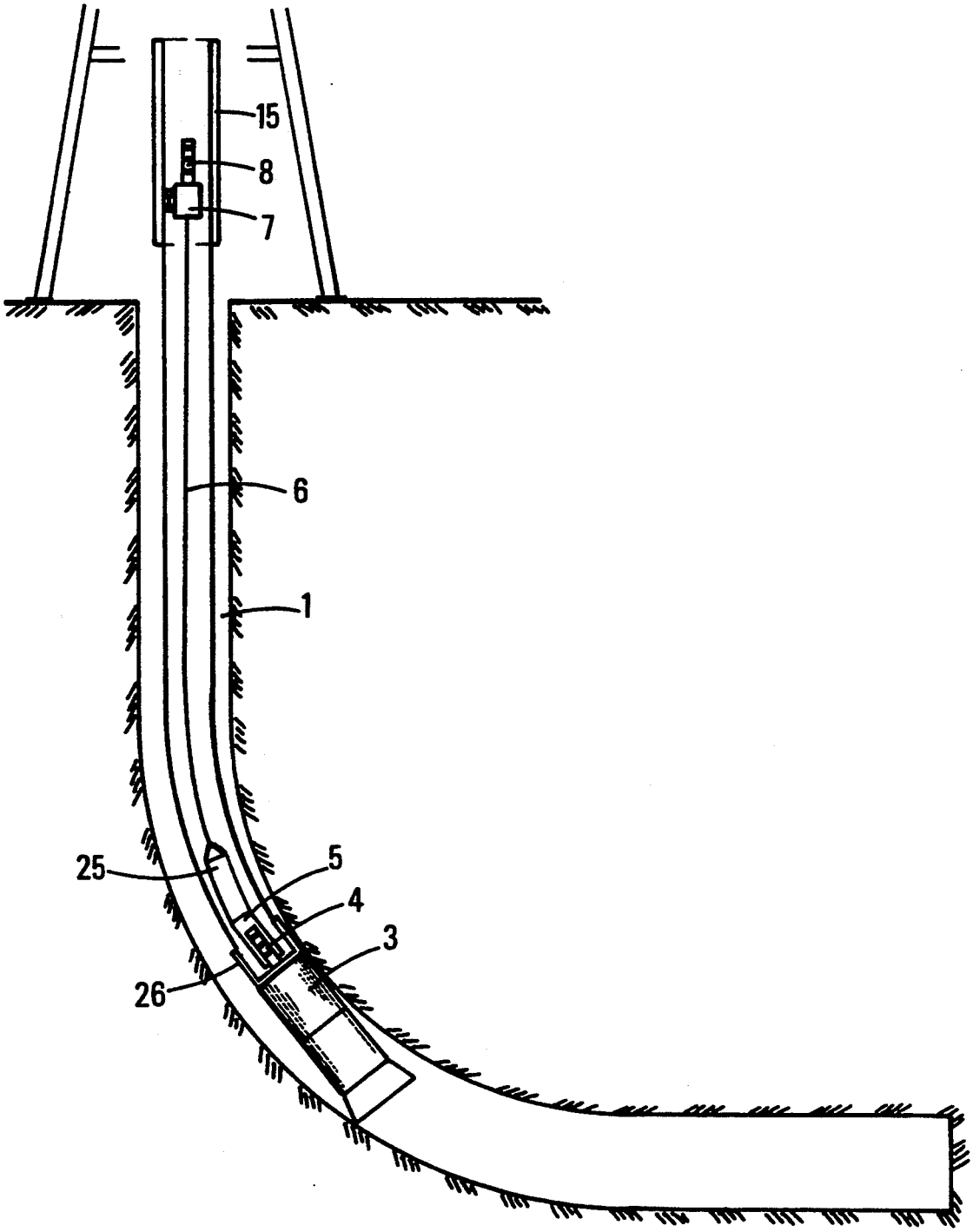
FIG. 2 shows another stage of the connection.

In the first case, operations begin by lowering into wellbore 1 assembly 3 and the first connector 4 thereof at the end of a length of drill string (FIG. 2). When said assembly has reached a determined depth, for example in drilling when the bottom is close, a sub 15 is screwed onto the top of the pipes and cable section 6 is constituted as follows : the second connector 5 is mechanically fastened to the end of a cable length wound round a logging winch, this cable is lowered into the drill string and connectors 4 and 5 are connected either by gravity or by pumping, as described in patent FR-2,501,777, the weight of the cable is held up by collars above sub 15, the cable is cut substantially above the sub and the first intermediate connector is mechanically fastened to the upper end of the section.

The first intermediate connector is made integral with a support 7 comprising a sleeve 19, said support being thereafter made integral with sub 15.

Figure 3:
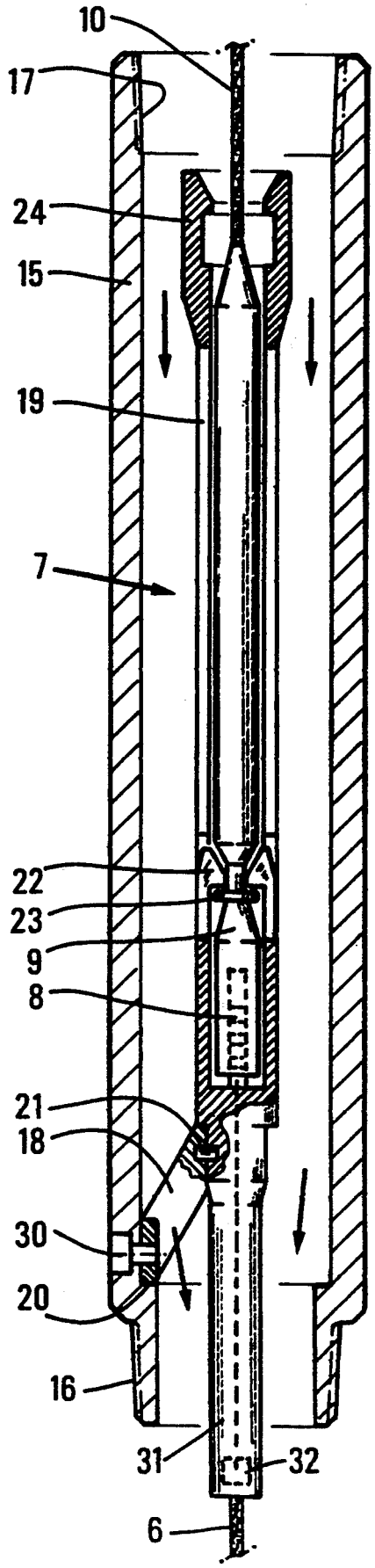
FIG. 3 shows one embodiment of the support of the intermediate connectors.

FIG. 3 shows in detail support 7 and sub 15.

Another operating procedure may also be followed for constituting section 6: before screwing sub 15, connector 5 is lowered into the drill string at the end of a cable and by means of a winch. The cable is cut and supported at the level of the upper pipe, then cable section 6 is mechanically fastened and electrically linked to the connector 8 integral with sleeve 19, which has already been set in sub 15. The assembly consisting of sub 15, sleeve 19 and section 6 is taken up by means of a winch and of thread 17, then thread 16 is screwed onto the upper pipe of the drill string.

Of course, once section 6 has been manufactured and equipped with these connectors, it may be used for another drilling. The length of the drill string will be adapted to the length of said section. The same pipes will generally be used so as to obtain the same length for the drill string.

Figure 2A:
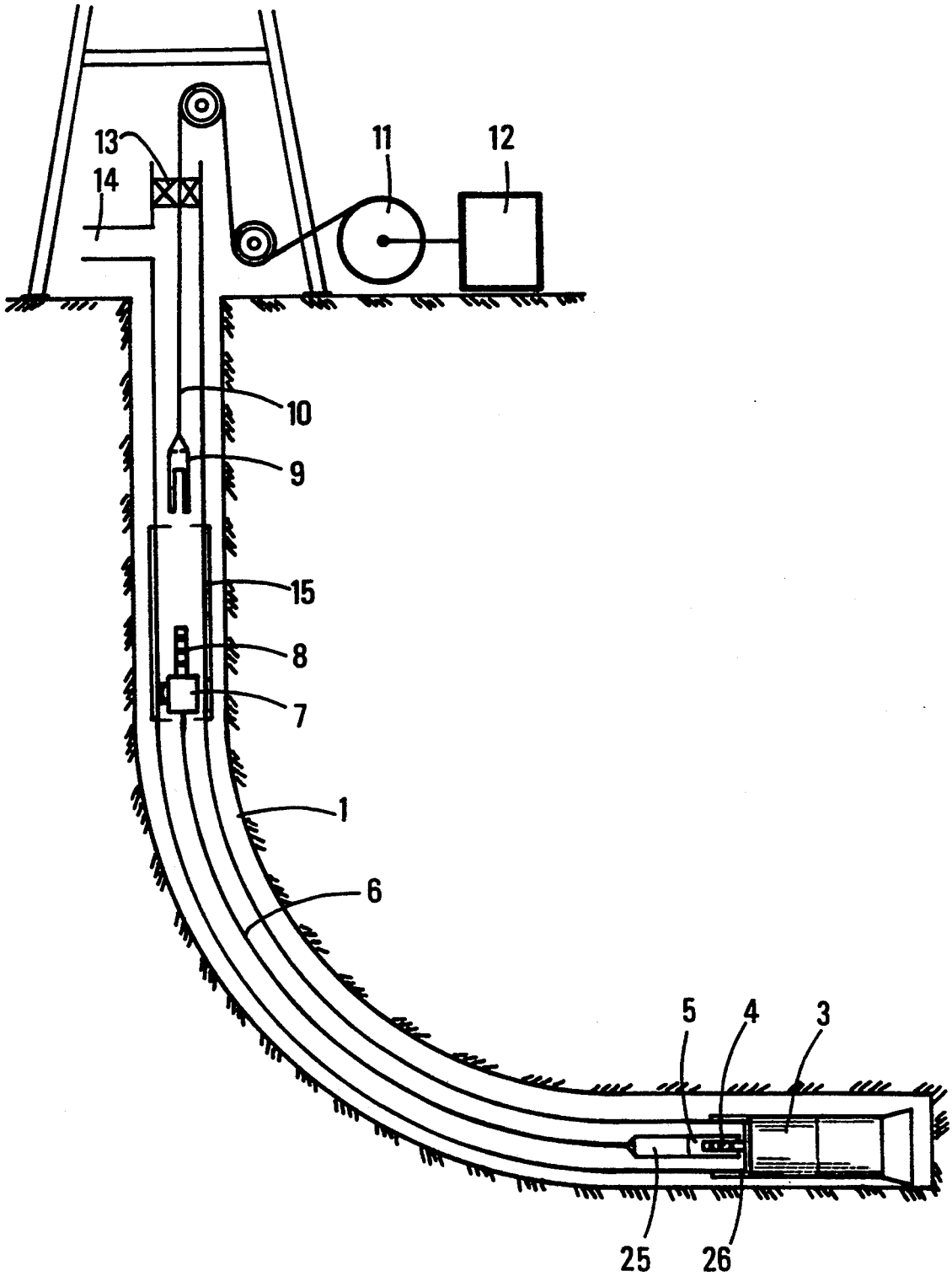
FIG. 2A shows the stage preceding the connection of the intermediate connector.

Above said sub 15, other pipes are assembled so as to follow the displacement of assembly 3; when assembly 3 is to be electrically linked to the surface, the second intermediate connector 9 is connected to the first intermediate connector 8. FIG. 2A shows this connection which is achieved with the same techniques as for connectors 4 and 5. Each time an operation which is made impossible through the presence of coaxial cable 10 is to be carried out, the second intermediate connector 9 just has to be disanchored first, cable 10 is taken up to the surface and operations may begin. It is thus notably possible to add pipes in a conventional way so as to deepen the wellbore, to rotate the whole of the string from a surface rotating means such as a rotary table or a power swivel.

Of course, the displacements may be performed upon taking down as well as upon taking up the drill string.

FIG. 3 shows an embodiment of a system of sub and support 7 of the first intermediate connector 8. Cable section 6 is mechanically fastened to connector 8 through a stop 32. The conductors of cable 6 are linked to connector 8 through conductors 31. A sub 15 comprises lower 16 and upper means 17 for fastening to said drill string. Suspension arms 18 lock the axial displacement towards the bottom of a sleeve 19 by co-operating with a shoulder 20 of sub 15. Arms 18 are adapted for letting the fluid circulate freely in the annulus thus created by the outside of sleeve 19 and the inside of said sub 15. The arms are made integral with sub 15 through means 30. A locking means 21, consisting for example of at least one shearable screw, makes sub 15 integral with sleeve 19 by means of arms 18. The first intermediate connector 8 is integral with sleeve 19. A traction exerted on the sleeve and higher than the shear strength of screw 21 releases the sleeve upwards by allowing the taking up of the sleeve, of the first intermediate connector and of section 6. This example is not limitative, sleeve 19 may also be fitted with locking fingers remote controlled from the surface as locking means 21. The second intermediate connector 9 connected to the first one is locked by means of fingers 22 integral with the sleeve, said fingers co-operating with a holding part 23 integral with the second intermediate connector. This holding part 23 may release the second conductor when the part is broken or may be moved aside by remote controlling from the surface a motor means located above intermediate connector 9. The upper end of sleeve 19 comprises a device 24 adapted for co-operating with an overshot (not shown here) lowered inside the drill string so as to fish up the sleeve, the first intermediate connector thereof and the whole of cable section 6. An overshot may also be fixed to sleeve 19 by means of fingers 22.

Without departing from the scope of this invention, support 7 may co-operate directly with the means for connecting the pipes with one another, such as pin-to-box subs, without adding any intermediate sub 15. Arms 18 just have to be adapted for being made integral with the pipes when the box and pin threads are screwed onto one another.

In the second case (FIG. 1A), the connection between the intermediate connectors is performed at the surface and connector 5, section 6, support 7 and the connector 8 thereof connected to connector 9 are taken down inside the drill string by means of cable 10 and winch 11. The connection of connectors 4 and 5 is achieved as described above. Support 7 is made integral with the drill string by remote control from the surface. The embodiment of support 7 is shown in FIGS. 4A and 4B.

Figure 4A:
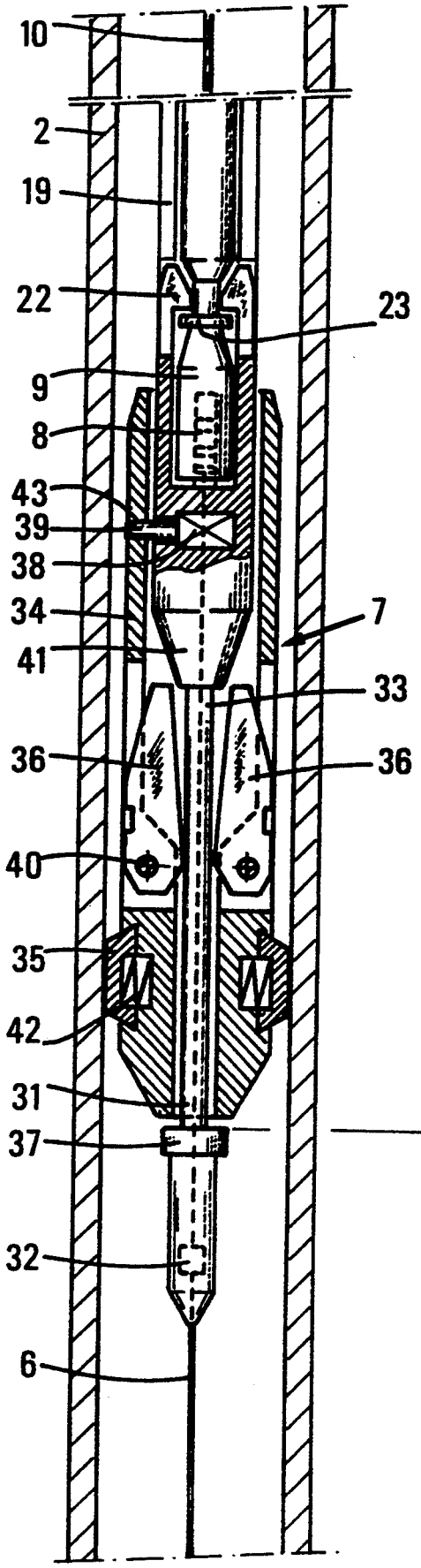
FIGS. 4A and 4B show another embodiment of the support of the intermediate connectors.
Figure 4B:
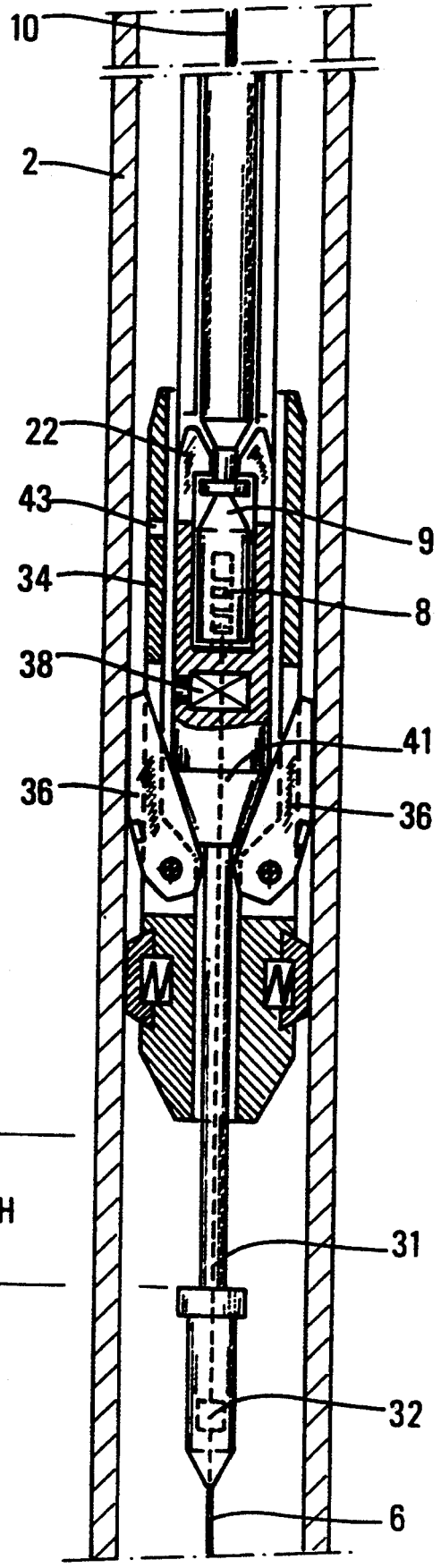

In FIG. 4A, support 7 is shown in the state in which it is lowered in line 2. It comprises a first connector 8 integral with a sleeve 19. Sleeve 19 is identical to that which is described in FIG. 3. Sleeve 19 is integral with a shaft 33 at the end of which cable section 6 is fastened by means of a stop 32. Conductors 31 link electrically the conductors of cable section 6 to intermediate connector 8. A body 34 comprising friction pads 35 and anchoring wedges 36 is arranged around shaft 33. The lower end of this body rests on a shoulder 37 integral with shaft 33. Body 34 is locked in a position of rest on shoulder 37 through the co-operation of a finger 39 of a locking system 38 integral with the shaft and of a hole 43 in body 34. Each anchoring wedge 36 can rotate round an axis 40 perpendicular to the longitudinal axis of the support. Springs (not shown) hold the wedges closed around the shaft. A means 41 for expanding the anchoring wedges is integral with the shaft. The friction pads 35 are radially pushed by springs 42. These springs 42 provide the contact force necessary between the line and the pads to have a sufficient longitudinal friction; besides, they allow the pads to retract upon the passing of sections of limited diameter at the level of the connections of the tubulars.

The support 7 of section 6 is connected to the surface through cable 10 equipped at the lower end thereof with the second intermediate connector 9. The locking of this connector 9 is achieved through the co-operating of fingers 22 and of a holding part 23 integral with the second connector 9.

The locking system 38 is controlled electrically from the surface by means of cable 10 linked to the shaft through the two connectors. It is advantageous for this lock to be reversible, that is that it may be unlocked or locked by remote control, notably from cable 10. Such a lock is well-known and may notably be achieved by means of motor means acting upon finger 39. But, in this invention, an unlocking system actuated through the break of finger 39, notably by explosive, will be sufficient in some cases. In another embodiment, the wedges may be integral with the shaft, while the expansion means is integral with the body.

FIG. 4B shows said support in the anchored state in line 2. The locking system 38 has been controlled so as to be unlocked and then, by means of cable 10, the shaft is made to slide over a distance H. The relative sliding between the shaft and the body is obtained by means of the friction pads which hold body 34 substantially fixed in relation to the line and through the action of a force displacing the shaft downwards. This force may be notably provided by the weight of the shaft, the weight of the ballast integral with the second connector 9, the weight of section 6 and/or the tension applied onto section 6 when the end thereof is anchored in assembly 3. It should be noted that, in inclined wells where the anchoring of the sonde 25 or of connector 5 on assembly 3 is generally indispensable, the support 7 according to the embodiment of FIG. 4A can be anchored without the preponderant action of gravity. The section just has to be tightened so as to lengthen it by a length greater than H, the body can thereafter be unlocked from the shaft before loosening the tension so as to bring support 7 into the state shown in FIG. 4B.

In the state shown in FIG. 4B, the relative displacement by a length H between the shaft and the body makes expansion means 41 co-operate with the anchoring wedges. The conical shape of the expansion means makes the wedges pivot round axes 40 until they lean against the wall of the line. The displacement force such as described above holds up the anchoring of support 7 in the line. The outer shape and the pivoting angle of the wedges allow the support to be anchored on sections of the line of different diameters. In fact, the tubulars used, drillpipes, casing, tubing, etc, often exhibit variations in the inside diameter, notably at the connections. The present support may be anchored at any level in a line having inside diameter variations.

Cable 10 and the connector 9 thereof can be taken up just by breaking holding part 23 or by controlling the moving aside thereof. Of course, in the first case, the tensile strength of part 23 must be lower than the disanchoring force of said support. This force being at least equal to that designated above as displacement force.

Disuniting or disanchoring the support is achieved by lowering again cable 10 and the connector 9 thereof equipped with a part 23 with a tensile strength higher than the anchoring force. This strength should also be higher than the force necessary for disanchoring section 6 from assembly 3, in case the latter is not remote controlled. If the holding part can be moved aside by remote control, this maneuvering of cable 10 can be avoided.

Without departing from the scope of this invention, the supports according to the embodiments of FIGS. 3 and 4A may comprise electronic means which can be lifted with said supports notably for amplifying or for helping in the transmission of information between sonde 25 or assembly 3 and the surface. These electronic means may be located at the upper end of said section 6 or at the lower end of cable 10.

Be it in the case of principle 1 or 2, support 7 is possibly adapted for holding section 6 substantially taut, the connection of connectors 4 and 5 being locked notably according to the same principle described in FIG. 3 for connectors 8 and 9.

Within the scope of this invention, it is possible to completely clear the inside of the drill string of all the coaxial elements. In fact, whether the embodiment of FIG. 3 or of FIG. 4 is used, by remote control and/or by traction on cable 10, support 7 is disunited from the inside of the drill string, then connectors 4 and 5 are disconnected before all the cables are taken up by means of winch 11.

It is also possible to take up cable 10 and the connector 9 thereof before lowering a fishing tool adapted for fastening onto device 24 or 22, said device 24 also equipping the embodiment according to FIG. 4A or 4B but not shown here. The fishing string disanchors support 7 so as to pull it out of the hole with section 6 after disconnecting connectors 4 and 5. Using such a fishing string can allow higher mechanical stresses, notably tensile stresses. Before disconnecting connectors 8 and 9, the connection of connectors 4 and 5 may have been unlocked.

In this invention, it will be possible to replace the function of connection and of electric link provided by connector 9 and cable 10 by using cabled pipes as described in document FR-2,607,975. The lower end of a first cabled pipe is adapted for connecting electrically onto the first intermediate connector 8 and mechanically onto the upper end of the drill string or of the thread 17 of sub 15 if there is any. The cabled pipes will just have to be assembled to one another for operations to be carried on. The assembling connects both mechanically and electrically the drill string to the bottom. At the surface, the last cabled pipe is connected to a swivel adapted for linking the conductors of the pipe to control cab 12 by means of a rotary electric joint having the same axis as the pipe. Said swivel may top a cabled kelly or be motorized.

The latter lay-out allows to turn the whole of the drill string and to bring additions without having to take up any electric cable length.

Of course, this solution may be mixed by using cable 10 notably by utilizing above cabled pipes an adapter comprising an intermediate connector similar to the first intermediate connector 8. Linking is achieved with this connector according to the present invention. The known cabled pipes leave the inner passageway free, it will therefore be possible to take up said section through these pipes by using a fishing tool and an adapted support 7.

Sonde 25 is lowered in the same way as connector 5, that is by gravity or by pumping.

Of course, sonde 25 is adapted for passing through the channel of the drill string, possibly of the cabled pipes and sub 15 if any.

Sonde 25 may comprise a slide and load bar system facilitating the adjustment of length of cable section 6.

Cable 10 can pass through a side-entry sub and go up to the surface through the well-drill string annulus. This use is interesting in cases where operations do not or not any longer require a possible rotation of the whole of the drill string. A side-entry sub consisting of two parts, which does not require to pass one end of the cable through the side-entry, will be advantageously used.

In one variant of the invention, assembly 3 comprises measuring and/or servicing means which are not electrically linked through the electric link provided by section 6 and cable 10. These means may notably comprise means of transmission by pressure or electromagnetic waves.

In another variant, which does not exclude the previous one, measuring and/or servicing means are linked electrically to a first connector 4 integral with said assembly and, in this case, sonde 25 will also comprise at the end thereof a second connector 5 adapted for connecting onto the first one.

Of course, the electric link may consist of several sections identical to that referenced 6 and described above without departing from the scope of this invention. In fact, the total device and method are equivalent, be there one or several sections.

I claim:

1. A system for carrying out measurements and/or services in a wellbore or in a well in the process of being drilled, said system comprising, at the end of a drill string, an assembly comprising a sub adapted to receive a sonde comprising measuring and/or servicing means, said drill string extending up to the surface, said sonde being fastened mechanically to a lower end of a cable section comprising electrical conductors and having another end fastened to a support which is adapted to be made integral with said drill string and which is integrally connected to a first intermediate electrical connector; a second intermediate electrical connector adapted to cooperate with said first intermediate connector; said second intermediate electrical connector being fastened mechanically to a lower end of a cable comprising electrical conductors and being linked electrically to the surface; said support being actuated within said drill string by remote control from the surface.; the support connected to the first intermediate electrical connector being placed in an inner channel of a conduit of the drill string and exhibiting two states wherein in a first state said support is anchored to said channel and in a second state said support is freely displaceable in said channel; a change from one state to the other being achieved through control from said cable linked to the surface and said support being adapted to be anchored in any zone of the inner channel of said conduit.

2. A system as claimed in claim 1, wherein said support is integrally connected to an inner wall of said drill string and is actuated by remote control to be disconnected from said drill string and to be displaceable within said drill string.

3. A system as claimed in claim 2, wherein said support is displaceable within said drill string and is actuated by a remote control from the surface to become integral with a zone of an inner wall of the drill string.

4. A system as claimed in claim 1, wherein said second intermediate connector is adapted to be taken up to the surface, said support being integral with the drill string.

5. A system as claimed in claim 1, wherein said sonde is anchored to said sub.

6. A system as claimed in claim 1, wherein said support is made integral on any zone of an interior channel of the drill string and is adapted to hold said cable section substantially taut.

7. A system as claimed in claim 1, further comprising recovery means for taking said cable section and said sonde up to the surface through said drill string said recovery means comprising either said cable or a fishing tool adapted to be connected onto an upper end of said support.

8. A system as claimed in claim 1, wherein said cable associated with the second intermediate connector is arranged to pass through a special sub fitted with a side-entry.

9. A system as claimed in claim 1, wherein said first intermediate electrical connector cooperates with a lower end of a first cabled pipe, wherein other cabled pipes are assembled above the first cabled pipe so as to displace the drill string and said assembly and wherein said first intermediate electrical connector is linked electrically to the surface through said cabled pipes.

10. A system as claimed in claim 1, wherein said sub comprises a means for effecting angular orientation of said sonde.

11. A system as claimed in claim 1, wherein said assembly comprises directional drilling means and the position of said drilling means is controlled from the surface through said measuring means.

12. A system as claimed in claim 1, wherein said assembly comprises other measuring and/or servicing means linked electrically to a first connector integral with said assembly and said sonde comprises a second connector adapted to connect onto the first connector.

13. A system as claimed in claim 1, wherein at least one of the second connector or of the sonde comprises weights including load bars and/or a device for pumping fluid into an internal channel of the drill string.

14. A system for carrying out measurements and/or services in a wellbore or in a well in the process of being drilled, said system comprising, at the end of a drill string, an assembly comprising a sub adapted to receive a sonde comprising measuring and/or servicing means, said drill string extending up to the surface, said sonde being fastened mechanically to a lower end of a cable section comprising electrical conductors and having another end fastened to a support which is adapted to be made integral with said drill string and which is integrally connected to a first intermediate electrical connector; a second intermediate electrical connector adapted to cooperate with said first intermediate connector; said second intermediate electrical connector being fastened mechanically to a lower end of a cable comprising electrical conductors and being linked electrically to the surface; said support being actuated within said drill string by remote control from the surface and said support being placed in an inner channel of a conduit of the drill string, said support exhibiting two states, wherein in a first state said support is anchored in said channel and in a second state said support is freely displaceable in said channel; a change from one state to the other state being achieved through control from said cable linked to the surface and said support being adapted to be anchored in any zone of the inner channel of said conduit; said support comprising a shaft integral on one side with said first intermediate electrical connector and on the other side with the cable section comprising electrical conductors, a body which is coaxial to said shaft and which is displaceable in translation between two extreme positions in relation to said shaft, said extreme positions corresponding to the two states, and a locking means for making said body integral with said shaft in the position corresponding to a displaceable state.

15. A system as claimed in claim 14, wherein the displaceable state of said support is removed by unlocking the locking means through an electrical remote control, the system being reversable and the anchoring state of said support being removed by applying traction force to said shaft through said cable linked to the surface.

16. A system as claimed in claim 14, wherein the body of said support comprises friction pads adapted to hold said body substantially fixed with respect to said channel when said shaft is displaced in translation between said two positions.

17. A system as claimed in claim 14, wherein said support further comprises anchoring wedges inoperative when said body is in a position of displacement for said support, said wedges being adapted to anchor the support in the channel through the cooperation of expansion means when said body is in an anchoring position and when the expansion means is integral with the shaft, the wedges are integral with the body or conversely.

18. A system as claimed in claim 14, wherein connection between the two intermediate electrical connectors is adapted to be disconnected when the support is maintained in an anchored state.

* * * * *